United States Patent [19]

Lopez et al.

[11] Patent Number: 4,941,597

[45] Date of Patent: Jul. 17, 1990

[54] DISPENSER WITH HEATED SPOUT

[75] Inventors: David A. Lopez, Newark, Del.; Luther Toulson, Marydel, Md.

[73] Assignee: Metal Masters Foodservice Equipment Co., Smyrna, Del.

[21] Appl. No.: 791,599

[22] Filed: Oct. 25, 1985

[51] Int. Cl.[5] ..... B67D 5/00

[52] U.S. Cl. ..... 222/146.5; 219/214; 219/301; 165/164

[58] Field of Search ..... 222/146.1, 146.2, 146.3, 222/146.4, 146.5, 566; 219/214, 301, 530, 535, 540, 365; 137/341; 165/164

[56] References Cited

U.S. PATENT DOCUMENTS

| | | | |
|---|---|---|---|
| D. 249,948 | 10/1978 | Brutsman | D15/111 |
| 2,621,903 | 12/1952 | Cohler | 165/164 X |
| 3,151,633 | 10/1964 | Shuman | 219/301 X |
| 3,548,158 | 12/1970 | McCaskill | 165/164 X |
| 3,596,804 | 8/1971 | Barrow et al. | 222/566 X |
| 3,823,851 | 7/1974 | Waters | 222/146.3 |
| 3,997,083 | 12/1976 | McNair | 222/146.5 |
| 4,094,446 | 6/1978 | Brutsman | 222/146.5 |
| 4,544,085 | 10/1985 | Frazer | 222/146.4 |

FOREIGN PATENT DOCUMENTS

| | | | |
|---|---|---|---|
| 823799 | 11/1959 | United Kingdom | 219/301 |

*Primary Examiner*—Joseph J. Rolla
*Attorney, Agent, or Firm*—Connolly & Hutz

[57] ABSTRACT

In a dispenser, spout heating structure is provided for maintaining the product in the spout in a flowable and uncongealed state. The heating structure includes a base which supports a heat conductive elongate block, the block having opposite side surfaces and a top surface that engages the underside of the spout in heat transfer relationship therewith. Heat from the elongate block is directly transferred to the spout, and a heat conductive sheath engages the upper portion of the spout and the side surfaces of the block to enhance heating of the spout to thereby maintain the product in a flowable condition.

10 Claims, 2 Drawing Sheets

DISPENSER WITH HEATED SPOUT

BACKGROUND OF THE INVENTION

The present invention relates to a dispenser, and more particularly to a dispenser having spout heating structure for maintaining the spout at an elevated temperature and the product contained therein in a flowable state.

Heated dispensers used to pump food products are well known in the art. Often it is required that such food products be maintained at specified minimum temperatures for health and sanitary reasons. Also, in many instances it is necessary to maintain the food product at an elevated temperature so that the product remains in a flowable state. Without suitable heating structure, many food products become extremely viscous and harden or otherwise congeal as their temperature is lowered. Accordingly, heated dispensers which store food products within specified temperature ranges are required. Such dispensers must also have characteristics which maintain the temperature of the spout at an elevated level.

SUMMARY OF THE INVENTION

It is therefore an object of the present invention to provide a dispenser having spout heating structure for reliably and efficiently maintaining the spout and the product contained therein at an elevated temperature.

Another object of the present invention is a dispenser with spout heating structure which is easy to maintain and relatively simple to assemble and disassemble.

In accordance with the present invention, a dispenser comprises a housing with a product container positioned within and supported by the housing. Heating structure is provided for maintaining the contents of the container at an elevated temperature, and a pump is used to dispense the product. A spout is connected to receive the product removed from the container, and spout heating structure functions to maintain the spout and the product contained therein at an elevated temperature. The product is thereby maintained in a flowable state. The spout heating structure includes a base upwardly extending from the housing and a heat conductive elongate block secured to the base. The block has opposite side surfaces and a top surface arranged to engage the underside of the spout in heat transfer relationship therewith. The block is heated, and a heat conductive sheath engages the upper portion of the spout and the side surfaces of the block in heat transfer relationship therewith.

The top surface of the block engages the underside of the spout, and often the spout and such top surface are angled to the horizontal by the same amount. Moreover, the top surface of the elongate block is generally flat to facilitate assembly and disassembly of the dispenser.

In one instance the heat conductive sheath is unitary and has a uniform thickness throughout. An alternative heat conductive sheath comprises two sections, each a mirror image duplicate of the other. These sheath sections may be removably attached to the side surfaces of the elongate block, and a substantial portion of the spout is totally surrounded by the two-piece heat conductive sheath. With either sheath arrangement, the surface of the sheath engaging the upper portion of the spout complements the surface of the spout along the entire length thereof.

BRIEF DESCRIPTION OF THE DRAWINGS

Novel features and advantages of the present invention in addition to those noted above will become apparent to those skilled in the art from a reading of the following detailed description in conjunction with the accompanying drawing wherein similar reference characters refer to similar parts and in which.

DETAILED DESCRIPTION OF THE INVENTION

Figure 2:
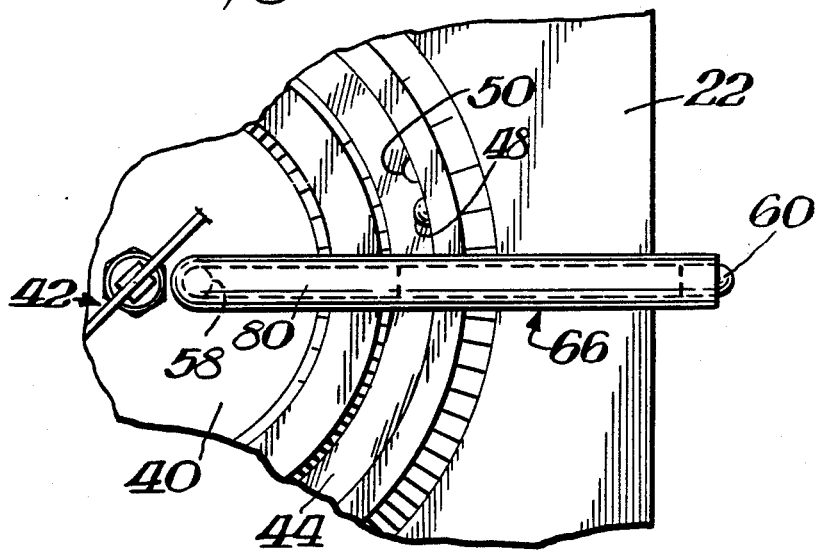
FIG. 2 is a partial top plan view of the heated dispenser particularly illustrating the heated spout thereof and its heat conductive sheath.
Figure 3:
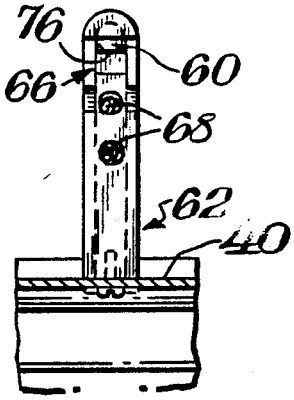
FIG. 3 is a sectional view taken along line 3—3 of FIG. 1.
Figure 1:
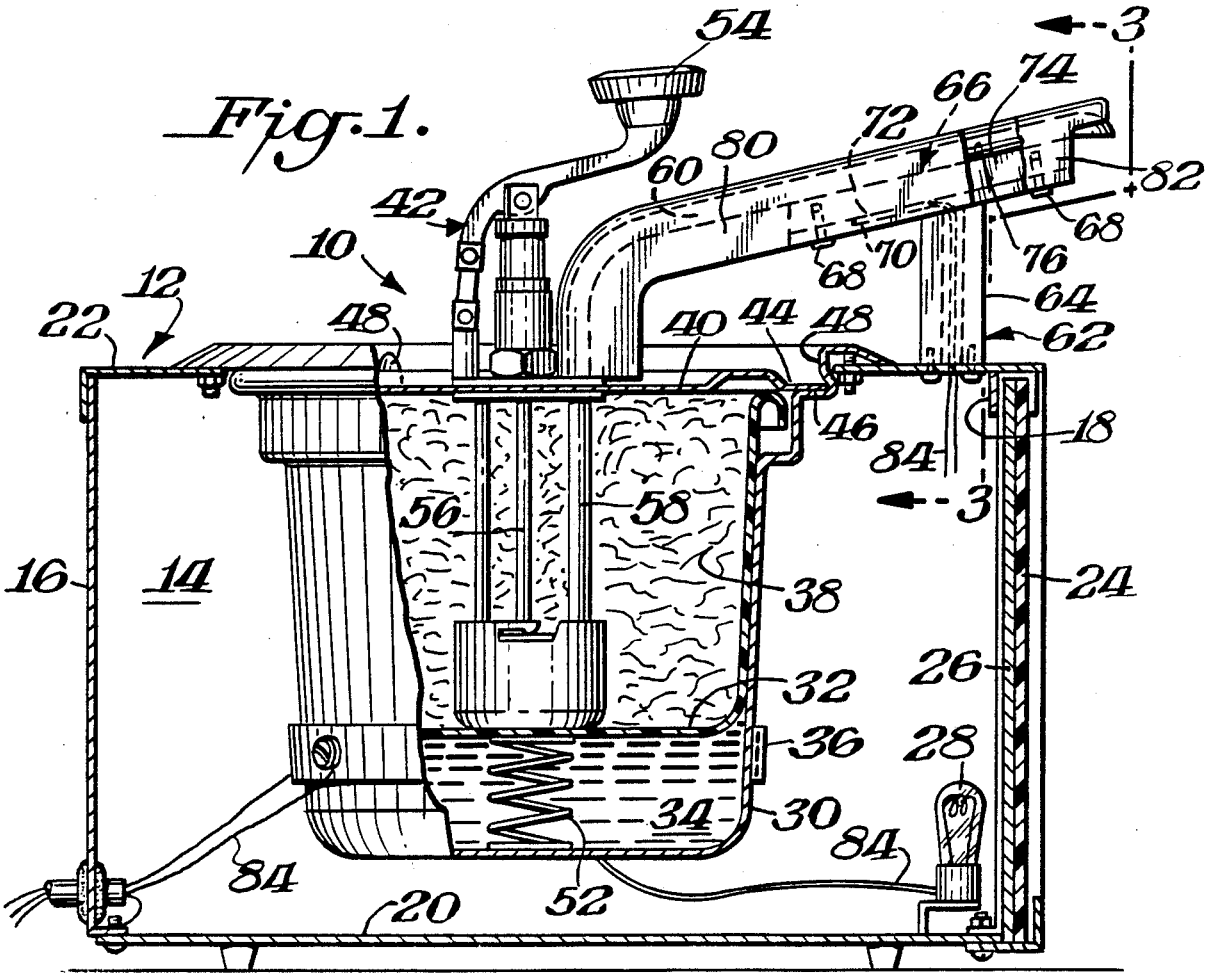
FIG. 1 is a sectional view of a heated dispenser according to the present invention, with portions thereof broken away to show interior details.
Figure 4:
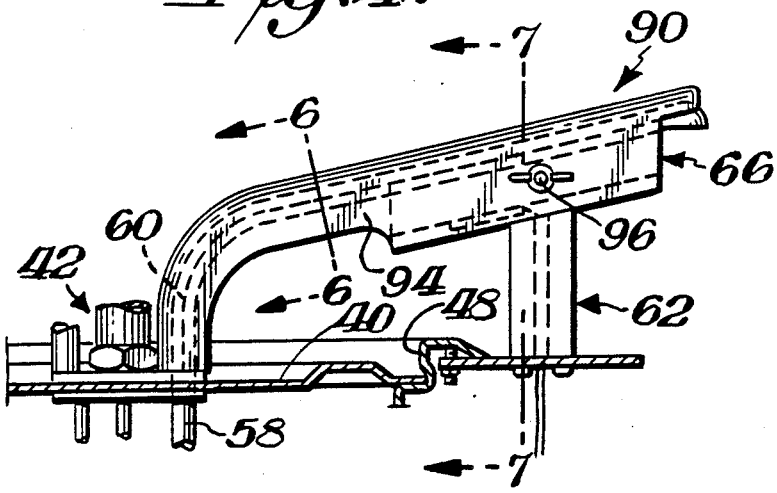
FIG. 4 is a view similar to FIG. 1 but only illustrating the heated spout and an alternative heat conductive sheath.
Figure 5:
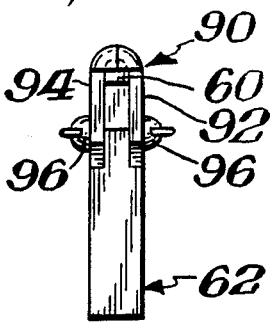
FIG. 5 is a front elevational view of the heated spout arrangement of FIG. 4.
Figure 6:
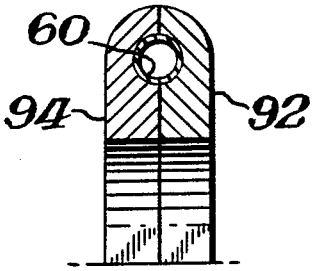
FIG. 6 is a sectional view taken along line 6—6 of FIG. 4.
Figure 7:
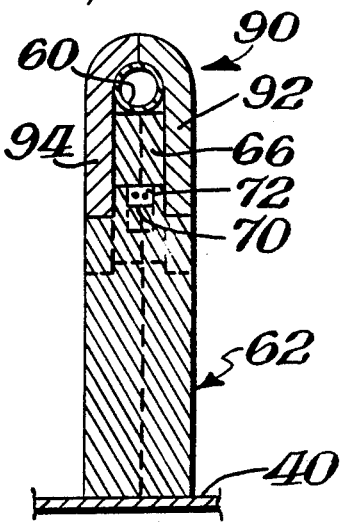
FIG. 7 is a sectional view taken along line 7—7 of FIG. 4.

Referring in more particularly to the drawing, FIGS. 1–3 illustrate a heated dispenser 10 primarily used for pumping hot food products, such as cheese mixtures and the like. Dispenser 10 primarily comprises a housing 12 formed by opposed sheet metal side walls 14, rear wall 16, and open front wall 18. A bottom panel 20 together with a top panel 22 completes the overall configuration of housing 12. A transparent window panel 24 is positioned at the front of the housing and a display sign 26 is also supported at the front directly behind window panel 24. A light source 28 within housing 12 serves to highlight the display sign.

A deep drawn bowl or well 30 rests within the housing 12, the upper circumferential portion of the well being supported by and secured to the top panel of the housing. A product container 32 less deep than well 30 rests within the well. Water 34 or other suitable liquid fills the volume between the respective bottom panels of the product container and the deep well while a band type heating element 36 surrounds the outside of the well at the lower end thereof to heat and maintain water 34 at an elevated temperature. The heated water functions to maintain contents 38 of product container 32 within a desired temperature range.

A lid 40 carries pump assembly 42 and serves to cover the upper open end of product container 32. An outer circumferential portion 44 on container lid 32 supportingly engages a circumferential flange 46 on well 30. Lid 40 is locked in place in its assembled position by an arrangement which includes several small undercuts 48 on well 30 adjacent circumferential flange 46 and a similar number of small cutouts 40 on the circular edge of lid 40. In use, cutouts 50 are simply positioned directly over undercuts 48 which allows lid 40 to drop onto support flange 46. The lid is locked in place by slight rotation thereof relative to well 30 which then positions the circular edge of the lid beneath undercuts 48. A coil spring 52 positioned between the respective bottom panels of well 30 and product container 32 operates to urge the upper rim of the product container against the undersurface of lid 40.

As noted above, lid 40 carries pump assembly 42 for dispensing the heated product stored within container 32. Generally the pump assembly includes an actuator 54 pivotally connected to a pump rod 56 which forces product 38 through a riser tube 58 connected to the entrance end of a spout 60 on the outside of lid 40. As is well known, palm pressure is utilized to manipulate actuator 54 which causes product 38 to flow to and through spout 60.

Heated dispenser 10 also includes spout heating means 62 which primarily comprises a base portion 64 supported by and upwardly extending from top panel 22 of housing 12. A heat conductive elongate block 66 is secured to base portion 64 by fasteners 68. A hollow 70 in base portion 64 carries a suitable heater element 72 which functions to heat elongate block 66. Block portion 66 has opposite flat side surfaces 74 and a flat top surface 76 arranged to engage the underside of spout 60 in heat transfer relationship therewith. The orientation of the spout and the top surface of the elongate block is such that the spout engages such top surface along the entire length thereof. In the embodiment shown in FIGS. 1–3, the spout and the top surface of the elongate block are inclined, each angled to the horizontal by the same amount.

Proper heating and temperature maintenance of spout 60 and the product therein is also enhanced by a heat conductive sheath 80 engaging the upper 180° portion of the spout in heat transfer relationship therewith. Sheath 80 includes opposite side surfaces 82 which frictionally engage side surfaces 74 of elongate block 66 in heat transfer relationship therewith. Sheath 80 is unitary in construction having a uniform thickness throughout. If desired, the sheath may be covered with a heat insulation layer on the outside surface thereof.

A suitable energy source (not shown) is connected by wiring 84 to energize band heater 36 and light bulb 28 as well as heater element 72 of spout heating structure 62. In use, heater element 72 significantly increases the temperature of the heat conductive elongate block 66. In turn, heat from the block is directly transferred to spout 60 via the contact between these parts. Sheath 80 is also heated through the heat transfer relationship between the opposite side surfaces 82 of the sheath and the opposite side surfaces 74 of block 66. The sheath is dimensioned so that the side surfaces 82 thereof intimately engage the sides of the block. The overall relationship of the heater element 72 and the heat transfer properties of block 66, spout 60 and sheath 80 are selected so as to maintain the temperature of the spout contents at or above a predetermined amount, such as 140° F. for example.

FIGS. 4–7 illustrate an alternate embodiment of the present invention utilizing heat conductive sheath 90 as a substitute for sheath 80. Otherwise, the structural arrangement is the same as described above and similar reference characteristics are used to identify similar parts. Heat conductive sheath 90 comprises two sections 92, 94, each a mirror image duplicate of the other. The sections are directly secured to the side surfaces 74 of elongate block 66 by fasteners 96. Sheath 100 is primarily different in that the proximal portion thereof extending from lid 40 to block 66 totally surrounds spout 60. In use, heat from block 66 is directly transferred to spout 60 via engagement of the spout with the block. Additionally, heat from block 66 is indirectly transferred to the spout via heat conductive sheath 90. The sheath is heated through the intimate contact of side surfaces 82 thereof and side surfaces 74 of the block. Here again, if desired, sheath 100 may be covered or otherwise coated with a heat insulation layer on the outside surface thereof.

Assembly and disassembly of heated dispenser 10 is easily accomplished. During assembly, once lid 40 is locked in place, spout 60 is located directly over block 66 in engagement with flat top surface 76. Sheath 80 is then fitted over the spout with the opposite side surfaces 82 thereof engaging the opposite side surfaces 74 of block 66. When sheath 90 is used, the sections 92, 94 are fitted over the spout and fasteners 96 function to secure the sections to the sides of the block.

What is claimed:

1. In a dispenser comprising a housing, a product container positioned within and supported by the housing, product heating means for maintaining the contents of the container at an elevated temperature, pump means for removing product from the container, a spout connected to receive product removed from the container by the pump, and spout heating means for maintaining the spout and the product contained therein at an elevated temperature whereby the product is maintained in a flowable state, the improvement according to which the spout heating means comprises a base upwardly extending from the housing and a heat conductive elongate block secured to the base, the block having opposite side surfaces and a top surface constructed and arranged to engage the underside of the spout in heat transfer relationship therewith, means heating the block, and a heat conductive sheath engaging the upper portion of the spout and the side surfaces of the block in heat transfer relationship therewith.

2. The combination of claim 1 wherein the spout and the top surface of the elongate block are inclined, each angled to the horizontal by the same amount.

3. The combination of claim 1 wherein the heat conductive sheath has a uniform thickness throughout.

4. The combination of claim 1 wherein the heat conductive sheath is unitary and has a uniform thickness throughout.

5. The combination of claim 1 wherein the heat conductive sheath comprises two sections, each a mirror image duplicate of the other.

6. The combination of claim 5 wherein the heat conductive sheath totally surrounds a substantial portion of the spout.

7. The combination of claim 5 including means for removably attaching the heat conductive sheath sections to the side surfaces of the elongate block.

8. The combination of claim 1 wherein the top surface of the elongate block is flat.

9. The combination of claim 1 wherein the surface of the heat conductive sheath engaging the upper portion of the spout complements the surface of the spout.

10. The combination of claim 1 wherein the heat conductive sheath engages the upper portion of the spout along the entire length of the spout.

* * * * *